US010753695B2

(12) United States Patent
Murphy, II et al.

(10) Patent No.: US 10,753,695 B2
(45) Date of Patent: Aug. 25, 2020

(54) BIOMETRIC ELECTRO-MECHANICAL LOCKING SYSTEM

(71) Applicants: William Lewis Murphy, II, Orlando, FL (US); Robert Vail Harvey, Orlando, FL (US)

(72) Inventors: William Lewis Murphy, II, Orlando, FL (US); Robert Vail Harvey, Orlando, FL (US)

(73) Assignee: Gun Guardian LLC, Orlando, FL (US)

( * ) Notice: Subject to any disclaimer, the term of this patent is extended or adjusted under 35 U.S.C. 154(b) by 0 days.

(21) Appl. No.: 16/156,960

(22) Filed: Oct. 10, 2018

(65) Prior Publication Data

US 2019/0145725 A1 May 16, 2019

Related U.S. Application Data

(60) Provisional application No. 62/570,245, filed on Oct. 10, 2017.

(51) Int. Cl.

| | |
|---|---|
| ***F41A 17/54*** | (2006.01) |
| ***F41A 17/06*** | (2006.01) |
| ***F41A 17/04*** | (2006.01) |
| ***F41C 23/10*** | (2006.01) |

(52) U.S. Cl.

CPC ..... *F41A 17/04* (2013.01); *F41A 17/54* (2013.01); *F41C 23/10* (2013.01); *F41A 17/066* (2013.01)

(58) Field of Classification Search

CPC ..... F41A 17/54; F41A 17/063; F41A 17/066; F41A 17/06; F41A 17/04; F41C 23/10

USPC ..... 42/70.07, 70.11, 70.06, 85, 90, 96, 106

See application file for complete search history.

(56) References Cited

U.S. PATENT DOCUMENTS

| | | | | | |
|---|---|---|---|---|---|
| 3,269,046 | A * | 8/1966 | Schaefer | F41A 17/54 | 42/70.06 |
| 3,583,088 | A * | 6/1971 | Buck | F41A 11/04 | 42/70.04 |
| 3,619,930 | A * | 11/1971 | Beermann | F41C 3/02 | 42/69.01 |
| 3,979,850 | A * | 9/1976 | Schiessl | F41A 11/04 | 42/71.02 |
| 4,689,908 | A * | 9/1987 | McClellan | F41C 23/10 | 224/198 |
| 5,924,229 | A * | 7/1999 | Brice | F41C 3/02 | 42/1.15 |
| 6,154,995 | A * | 12/2000 | Lenoir | F41A 17/06 | 42/70.07 |

(Continued)

*Primary Examiner* — Jonathan C Weber

(74) *Attorney, Agent, or Firm* — Jason T. Daniel, Esq.; Daniel Law Offices, P.A.

(57) ABSTRACT

A biometric electro-mechanical locking system for a firearm includes a generally hollow main body having a pivot plate that is secured along the first end. A hand grip is positioned along the main body and configured to slide between a FIRE position where the trigger assembly of the firearm is accessible, and a SAFE position where the trigger assembly of the firearm is not accessible. A release button is positioned along the main body and is mechanically coupled to a dual locking assembly that is positioned within the main body. The dual locking assembly including an electromechanical locking unit having a processor, memory, fingerprint sensor and electric servo, and a mechanical locking unit having a mechanical combination lock.

9 Claims, 6 Drawing Sheets

(56) References Cited

U.S. PATENT DOCUMENTS

| | | | | |
|---|---|---|---|---|
| 6,234,058 | B1 * | 5/2001 | Morgado | F41A 3/04 102/376 |
| 6,253,480 | B1 * | 7/2001 | Florez | F41A 17/06 42/70.06 |
| 6,474,011 | B1 * | 11/2002 | Sato | F41A 17/02 42/70.08 |
| 7,941,954 | B2 * | 5/2011 | Carr | F41A 11/04 42/36 |
| 8,522,582 | B2 | 9/2013 | Keightley | |
| 9,097,479 | B1 * | 8/2015 | Barido | F41A 17/066 |
| 9,121,655 | B1 * | 9/2015 | Murphy, II | F41A 17/06 |
| 9,404,699 | B1 * | 8/2016 | Barido | F41A 17/54 |
| 9,459,064 | B1 * | 10/2016 | Xu | F41A 17/54 |
| 9,651,325 | B1 * | 5/2017 | Gant | F41A 17/06 |
| 9,733,033 | B1 * | 8/2017 | Barido | F41A 17/066 |
| 9,810,500 | B2 * | 11/2017 | Murphy, II | F41A 17/06 |
| 9,945,629 | B2 * | 4/2018 | Osborne | F41A 9/17 |
| 9,970,725 | B2 * | 5/2018 | Kiyani | F41A 17/063 |
| 10,161,702 | B2 * | 12/2018 | Xu | F41A 17/54 |
| 10,274,276 | B2 * | 4/2019 | Full | F41A 11/04 |
| 10,378,846 | B2 * | 8/2019 | Murphy, II | F41A 17/066 |
| 2009/0277066 | A1 * | 11/2009 | Burt | F41A 3/66 42/6 |
| 2011/0072705 | A1 * | 3/2011 | Simpkins | B25F 1/04 42/59 |
| 2014/0182180 | A1 * | 7/2014 | Murphy, II | F41A 17/06 42/70.07 |

* cited by examiner

BIOMETRIC ELECTRO-MECHANICAL LOCKING SYSTEM

CROSS-REFERENCE TO RELATED APPLICATIONS

This application claims the benefit of U.S. Application Ser. No. 62/570,245 filed on Oct. 10, 2017, the contents of which are incorporated herein by reference.

TECHNICAL FIELD

The present invention relates generally to dual locking mechanisms, and more particularly to a firearm locking device with a dual lock apparatus having two independent means of acting on a lock.

BACKGROUND

The statements in this section merely provide background information related to the present disclosure and may not constitute prior art.

There are numerous types of locks in existence today that are used to secure various devices ranging from doors, to safes and firearms, for example. Historically, such locks have been constructed as purely mechanical devices having a key slot or combination code that must be accessed to transition the lock between an open and closed orientation. These mechanical locks are useful for their simplicity, but can be time consuming to operate, especially when used on a firearm, for example, where access to the weapon is needed in an emergency situation.

In recent years there has been an increased development of electromechanical locking mechanisms which utilize an electrically driven bolt and/or an electrically-operated authentication device such as an electric keypad, RFID interrogator and/or biometric sensor, for example. Such systems are extremely useful as they are able to transition between a locked and unlocked orientation extremely quickly. Unfortunately, such systems are prone to difficulties such as circuit or power failures that can disable the system from working as intended.

As such, it is common for such devices to have a backup key which can manually transition the lock upon the occurrence of such a failure. Although this is a useful feature in non-emergency situations, it is impractical for a user to have to unexpectedly find a key to manually unlock a firearm with a broken electronic lock in an emergency situation where the weapon is needed immediately.

Accordingly, it would be beneficial to provide for a firearm having a backup manual combination locking system for providing two distinct and independent means for unlocking a weapon, so as to provide the benefits of both a mechanical and electromechanical lock while overcoming the drawbacks associated with both.

SUMMARY OF THE INVENTION

The present invention is directed to a biometric electro-mechanical locking system for a firearm. One embodiment of the present invention can include a generally hollow main body having a pivot plate that is secured along the first end. A hand grip is positioned along the main body and configured to slide between a FIRE position where the trigger assembly of the firearm is accessible, and a SAFE position where the trigger assembly of the firearm is not accessible. The system can also include a release button that is positioned along the main body and can functioning to allow the system to transition between the SAFE position and the FIRE position when engaged. The system can also include a dual locking assembly that is positioned within the main body to control an operation of the release button.

In one embodiment, the dual locking assembly can include an electromechanical locking unit and a mechanical locking unit that are each coupled to the release button and are configured to independently allow an operation of the release button.

In one embodiment, the electromechanical locking unit can include an internal processor, memory, fingerprint sensor and electric servo. In one embodiment, the mechanical locking unit can include a mechanical combination lock.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1A:
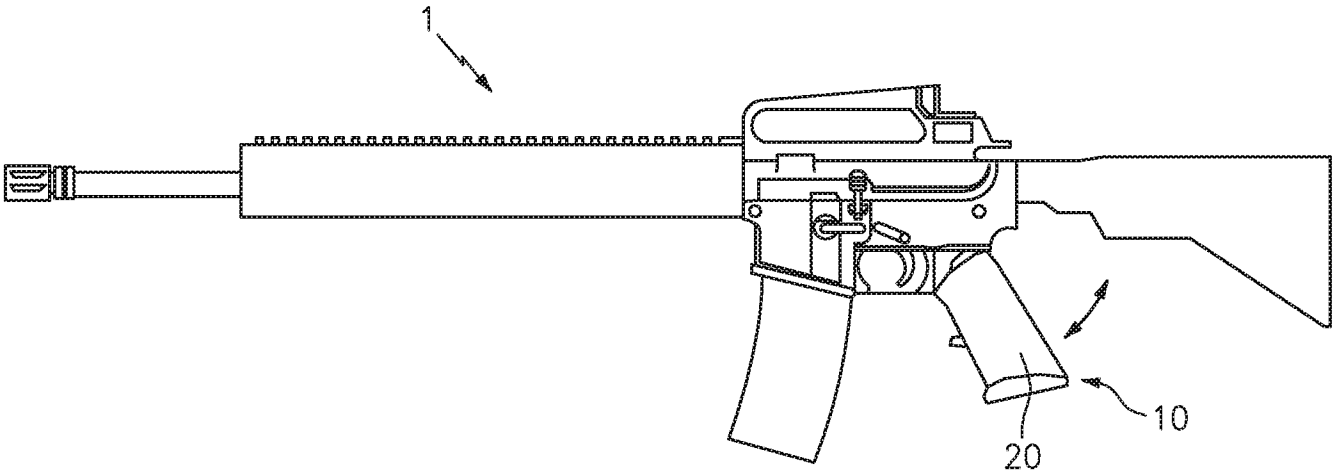
FIG. 1A is a side view of a biometric electro-mechanical locking system in the FIRE position on a firearm, in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

In the preferred embodiment, the biometric electro-mechanical locking system can be incorporated directly into a protective trigger guard enclosure such as that described in U.S. Pat. No. 9,121,655 to Murphy, the contents of which are incorporated herein by reference. Of course, the inventive concepts are not to be construed as limiting to this utilization, as the locking functionality of the device can be equally incorporated into any number of other devices for providing an independent keyless dual locking mechanism.

FIGS. 1A-5 illustrate one embodiment of a biometric electro-mechanical locking system 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown throughout the drawings, the system 10 can include a sliding handgrip 20 and a main body 30 that houses a dual locking assembly 40.

Figure 1B:
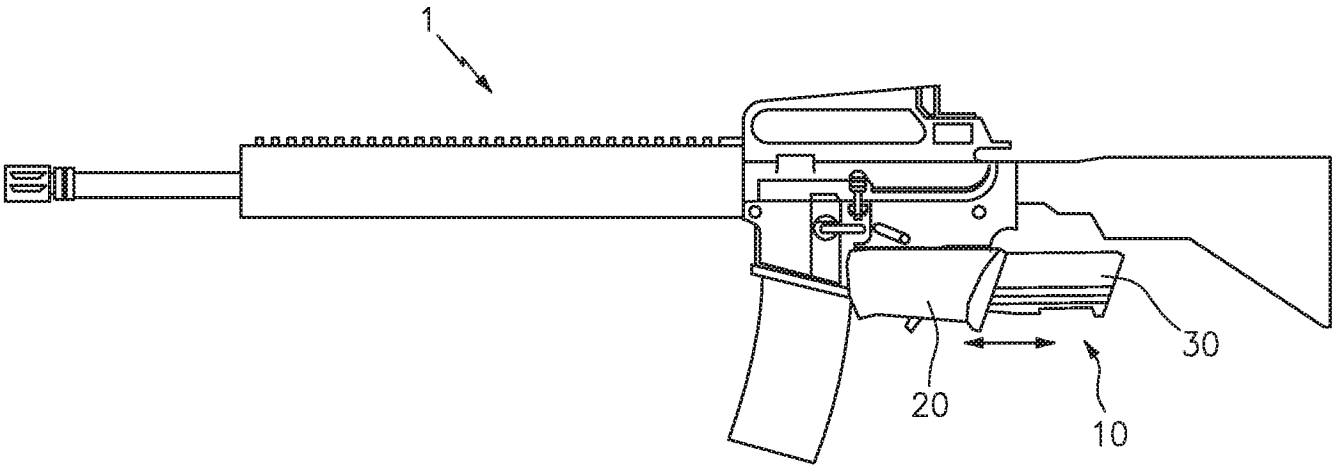
FIG. 1B is a side view of a biometric electro-mechanical locking system in the SAFE position on a firearm, in accordance with one embodiment of the invention

As shown in FIGS. 1A and 1B, one embodiment of the system 10 can be secured to a firearm 1 in place of the factory grip, by utilizing the factory-supplied grip mounting hardware, so as to selectively transition between the unlocked/FIRE position and the locked/Safe position.

Figure 2A:
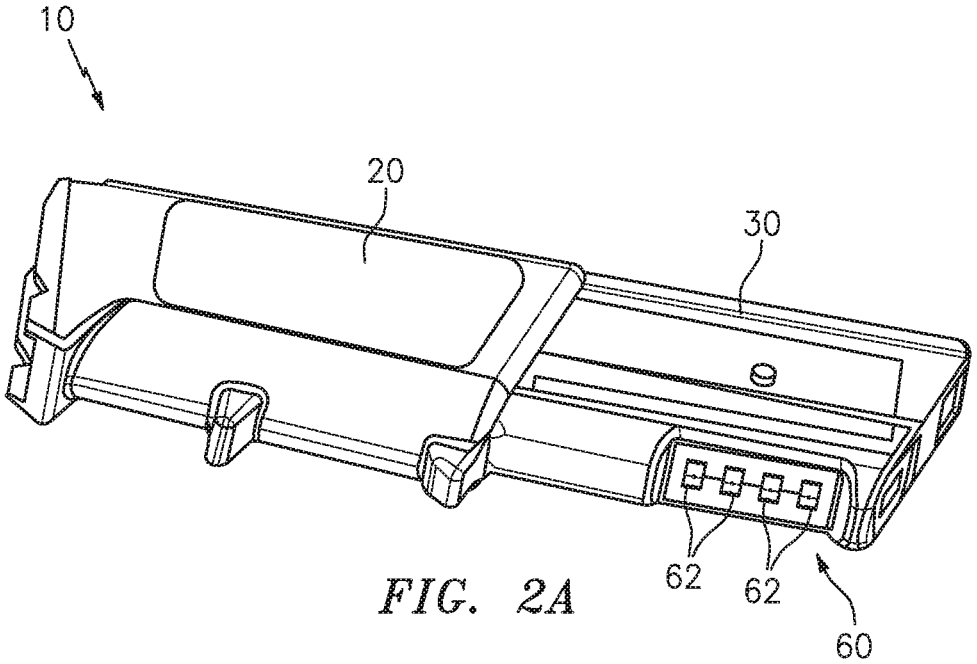
FIG. 2A is a perspective view of the biometric electro-mechanical locking system in the SAFE position, in accordance with one embodiment of the invention.
Figure 2B:
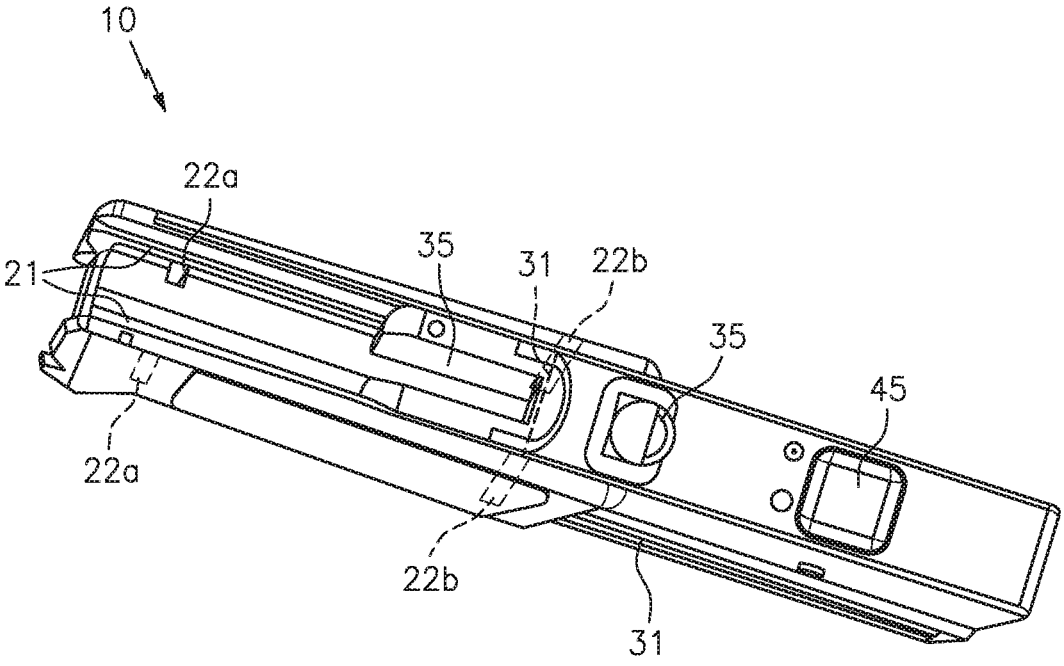
FIG. 2B is a bottom view of the biometric electro-mechanical locking system in the SAFE position, in accordance with one embodiment of the invention.

As shown best in FIGS. 2A and 2B, the sliding hand grip 20 can include a shape and size that is suitable for use as a handgrip for a firearm. The sliding grip can include a pair of grooves 21 that run longitudinally along the hollow interior portion of the hand grip body. In one embodiment, the channels 21 can include two pairs of slits 22*a* and 22*b*, that are positioned perpendicularly along both ends of the grooves.

The main body 30 can include a shape and size that is suitable for being positioned within the interior space of the sliding hand grip. As shown, a locking pin 31 can extend outward from the main body and can be positioned within the grooves 21. When the system is in the FIRE position, the ends of the locking pin 31 can be aligned with or positioned within the slits 22*a*. Likewise, when the system is in the SAFE position, the ends of the locking pin 31 can be aligned with or positioned within the slits 22*b*.

In order to allow the system to transition between the SAFE and FIRE positions, a user must depress the release button 32, thereby shifting the location of the locking pin and allowing the handle 30 to slide along the length of the main body. As will be described below, the system is designed to always allow actuation of the release button 32 when transitioning from the FIRE position to the SAFE position but requires user authentication to allow actuation of the release button when transitioning from the SAFE position to the FIRE position.

In the preferred embodiment, user authentication can be accomplished via either successful verification of the user identity using a biometric sensor 45 or by entering the proper combination on the mechanical lock 60.

Figure 3:
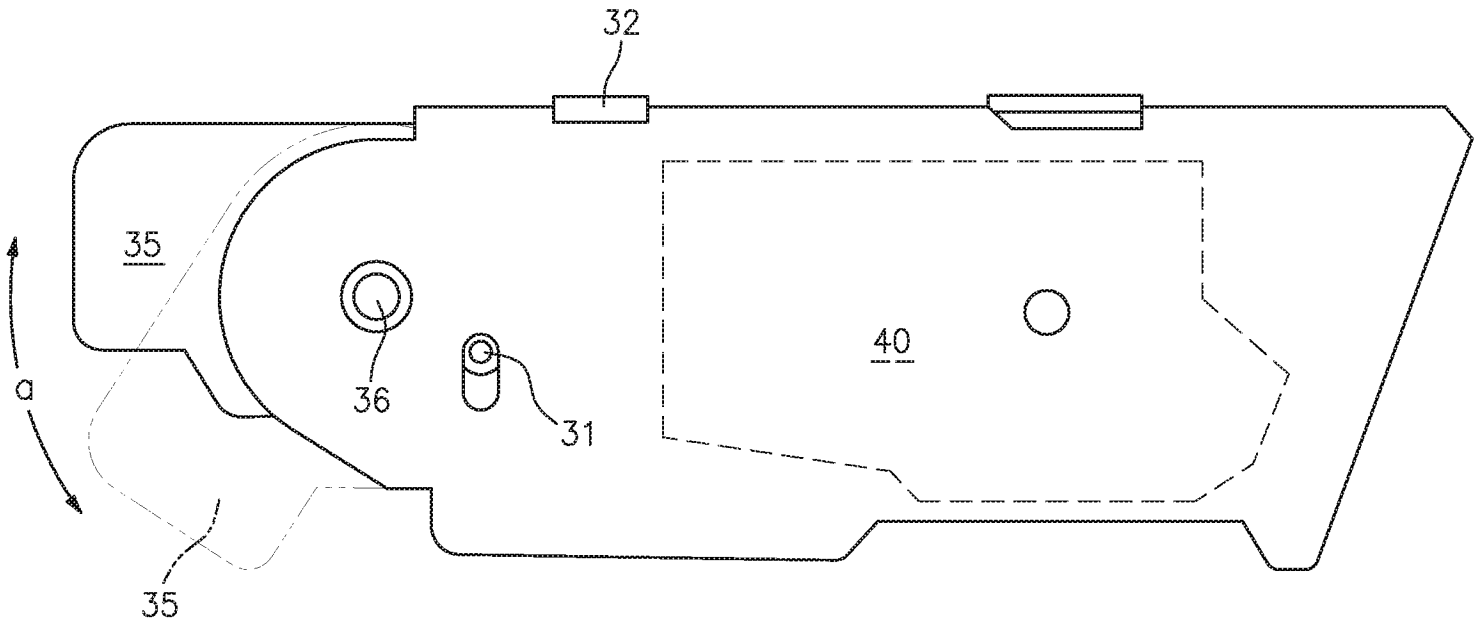
FIG. 3 is a side view of the biometric electro-mechanical locking system in the FIRE position, in accordance with one embodiment of the invention.

As shown in FIG. 3, the main body 30 can include an attachment pivot plate 35 that is secured along the first end of the main body. The distal end of the pivot plate can be secured to the firearm 1, via hardware as described above. The pivot plate can be mechanically linked to the release button 32 and can pivot (see arrow a) approximately 45 degrees about a central pin 36 in order to allow the system to rotate between the SAFE and FIRE positions illustrated in FIGS. 1A and 1B. Operation of the release button 32 is governed by the below described dual locking assembly 40 that is positioned within the main body 30.

Figure 4A:
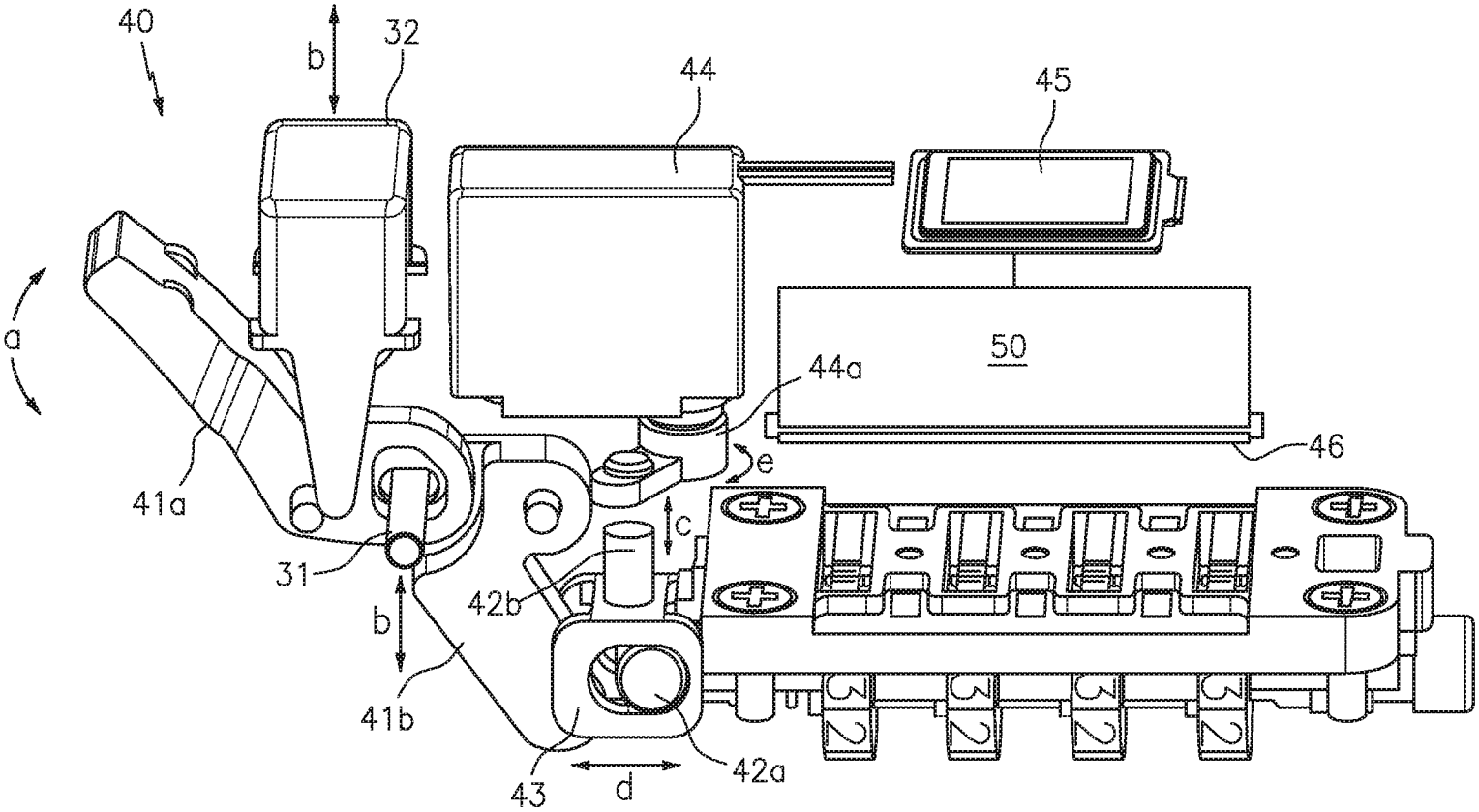
FIG. 4A is a cutout view of the dual locking assembly of the biometric electro-mechanical locking system, in accordance with one embodiment of the invention.
Figure 4B:
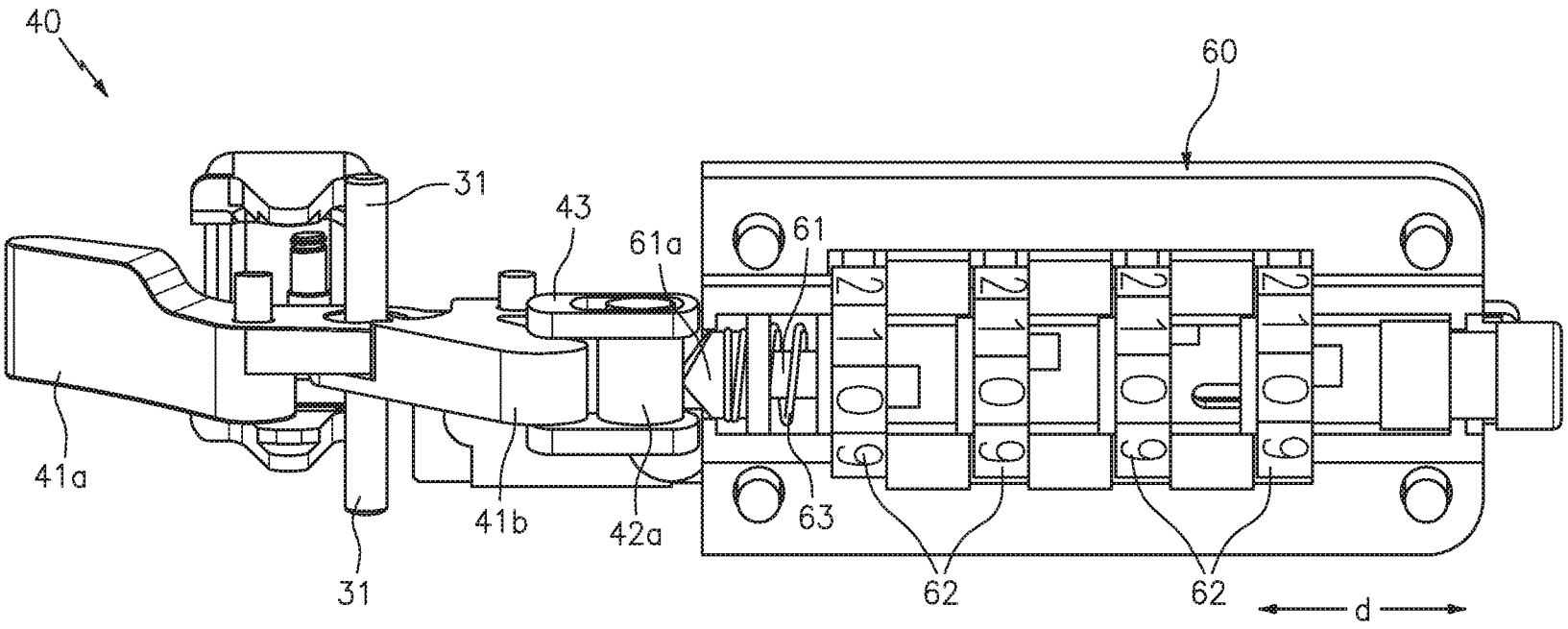
FIG. 4B is another cutout view of the dual locking assembly of the biometric electro-mechanical locking system, in accordance with one embodiment of the invention.

FIGS. 4A and 4B illustrate one embodiment of the dual locking assembly 40. As shown, the assembly can include both mechanical and electromechanical components that can function to independently allow movement of the release button 32 in order to allow the system to be transitioned between the SAFE and FIRE positions. In one embodiment, the assembly can include linkage shafts 41*a* and 41*b* that are mechanically coupled to the release button 32 and are joined together via the locking pin 31. As noted above, the ends of the locking pin can be located within the elongated grooves 21 of the sliding handle and can be positioned within the slits 22*a* and 22*b* when the device is locked in the FIRE and SAFE positions, respectively.

The distal end of linkage shaft 41*a* is coupled to the pivot plate 35 (removed for ease of illustration) and the linkage shaft 41*b* is coupled to a two way plunger. The two way plunger can include a generally inverted T-shaped member having a horizontal bottom end 42*a* and an elongated top end 42*b*. The bottom end is positioned within an elongated slit 43 of a frame section that is coupled to the main body 30.

As shown by arrows b, movement of the button 32 causes movement of the locking pin 31 which causes rotation of the linkage shaft 41*a* thus allowing the pivot plate to operate as described above. Additionally, this movement causes linkage shaft 41*b* to pivot and engage the bottom end 42*a* of the two way plunger. Depending on the configuration of the electromechanical and mechanical components described below, this engagement causes either vertical movement of the plunger shown by arrow c or horizontal movement of the plunger as shown by arrow d.

In one embodiment, the electromechanical components of the locking assembly (i.e., electromechanical locking unit) can function to prevent operation of the button 32 by preventing the vertical movement of the upper end of the two way plunger 42*b*. To this end, the assembly can include an electrical servo 44 having a servo arm 44*a* that rotates laterally (see arrow e) to selectively block the path of the plunger. The servo can be in communication with a biometric sensor 45, a power source 46 and a controller 50. Upon successful authentication of the user, the controller can instruct the servo arm to move to a position that does not interfere with the vertical movement of the plunger 42*b*, and the system can transition from the SAFE to the FIRE position.

Figure 5:
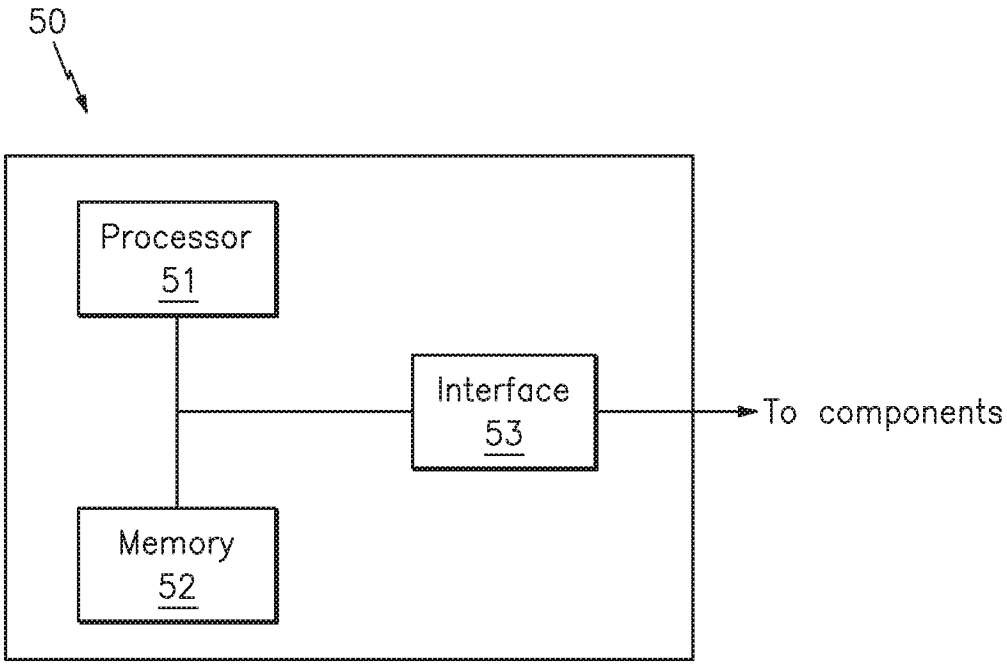
FIG. 5 is a block diagram of the controller of the biometric electro-mechanical locking system, in accordance with one embodiment of the invention.

FIG. 5 illustrates one embodiment of the controller 50 that includes a processor 51 that is conventionally connected to an internal memory 52, and a component interface unit 53.

Although illustrated as separate elements, those of skill in the art will recognize that one or more assembly components may comprise or include one or more printed circuit boards (PCB) containing any number of integrated circuit or circuits for completing the activities described herein. The CPU may be one or more integrated circuits having firmware for causing the circuitry to complete the activities described herein. Of course, any number of other analog and/or digital components capable of performing the below described functionality can be provided in place of, or in conjunction with the below described controller elements.

The processor/CPU 51 can act to execute program code stored in the memory 52 in order to allow the device to perform the functionality described herein. Memory 52 can act to store operating instructions in the form of program code for the processor 51 to execute.

The component interface unit 53 can function to provide a communicative link between the processor 51 and various other device components such as the servo 44, the biometric sensor 45, and/or the power source 46, for example. In this regard, the component interface unit can include any number of different components such as one or more PIC microcontrollers, internal bus, USB connections and other such hardware capable of providing a direct link between the various components. Of course, any other means for providing the two way communication between the device components can also be utilized herein.

As described herein, the biometric sensor 45 can function to record the fingerprint of an authorized user and store the image of the fingerprint in the memory 52. As such, upon recognition of the user's fingerprint applied to the sensor, the processor can instruct the servo to transition the servo arm to a location that does not block passage of the two way plunger, thereby allowing the system to transition from the SAFE position to the FIRE position. Of course, the biometric sensor is not limited to the use of a fingerprint sensor, as any number of other known systems for receiving and/or verifying a user input are also contemplated. Several non-limiting examples include the use of a wireless authentication system such as an RFID interrogator that can be used with an externally located RFID sensor, for example.

In the preferred embodiment, the power source 46 can include one or more DC batteries capable of providing the necessary power requirements to each element of the system 10. In one embodiment, the batteries can be permanently located within the main body 30 and can be rechargeable in nature via a charging port 46*a* such as a mini or micro USB port, for example. Of course, traditional batteries can also be utilized, and the main body can further include a battery compartment having a removable cover (not illustrated) for allowing a user to access the same.

Returning to FIG. 4B, in one embodiment, the mechanical components of the locking assembly (i.e., mechanical locking unit) can function to prevent operation of the button 32 by preventing the horizontal movement of the bottom end of the two way plunger 42*a*. To this end, the assembly can include a mechanical lock 60 having an elongated cylinder 61 and a series of dials 62. A spring 63 imparts tension onto the cylinder to maintain the cylinder in the extended position. The mechanical lock including a series of lands and grooves that function in the expected manner whereby retraction of the cylinder is allowed only when the dials are aligned, and the lock is in the unlocked position.

To this end, when the mechanical lock 60 is in the locked position, the distal end of the cylinder 61*a* is in communication with the bottom end of the plunger 42*a* and prevents horizontal movement (arrow d) of the plunger by the linkage shaft 41*b*. Conversely, when the mechanical lock is in the unlocked position, movement by the linkage shaft 41*b* causes horizontal movement of both the plunger 42*a* and the cylinder, thus allowing the system to transition from the SAFE position to the FIRE position.

In either instance, when either the mechanical or electromechanical elements of the dual locking assembly are in the unlocked position, the button 32 is able to move freely, and results in perpendicular movement of the ends of the locking pin 31 within the slits 22*a* and 22*b*, relative to the channel 21. Such movement is necessary to allow the device to transition between the FIRE and SAFE positions. Conversely, when both the mechanical and electromechanical elements of the dual locking assembly are in the locked position, and/or when the ends of the locking pin 31 are not positioned within the slits, operation of the button is prevented, and the system will not transition from the SAFE position to the FIRE position.

Accordingly, the above described system functions to provide an integrated firearm safety device having two distinct and independent means for unlocking a weapon.

As described herein, one or more elements of the biometric electro-mechanical locking system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A firearm locking system, comprising:

a main body having a first end, a second end, and a plurality of sides;

a pivot plate that is secured along the first end of the main body, said pivot plate being configured to secure the main body to a firearm;

a hand grip that is slidingly engaged to the main body, said hand grip being configured to transition between a FIRE position where a trigger assembly of the firearm is accessible, and a SAFE position where the trigger assembly of the firearm is not accessible;

a release button that is positioned along the main body, said release button functioning to allow the system to transition between the SAFE position and the FIRE position when engaged; and a dual locking assembly that is positioned within the main body, and configured to control an operation of the release button to transition from the SAFE position to the FIRE position, wherein the dual locking assembly includes an electromechanical locking unit and a separate mechanical locking unit that are each independently coupled to the release button and are each configured to independently allow an operation of the release button, and wherein the dual locking assembly does not control an operation of the release button to transition from the FIRE position to the SAFE position.

2. The system of claim 1, wherein the electromechanical locking unit includes an electrical servo that is configured to selectively interfere with a movement of the release button.

3. The system of claim 2, further comprising:

a biometric sensor that is disposed along the main body, said biometric sensor being configured to control an operation of the electrical servo.

4. The system of claim 3, wherein the biometric sensor comprises a biometric fingerprint sensor.

5. The system of claim 1, further comprising:

a controller having a processor and a memory; and a battery.

6. The system of claim 5, further comprising:

a charging port that is disposed along the main body and is in electrical communication with the battery.

7. The system of claim 1 wherein the mechanical locking unit includes a combination lock that is positioned along the main body.

8. The system of claim 7, wherein the combination lock includes a cylinder that is configured to selectively interfere with a movement of the release button.

9. A firearm, comprising:

a receiver having a back end and a bottom end;

a trigger assembly that is positioned along the bottom end of the receiver;

a locking grip that is positioned adjacent to the trigger assembly, said locking grip including a main body having a first end, a second end, and a plurality of sides, a pivot plate that is secured along the first end of the main body, said pivot plate being in communication with the bottom end of the receiver, a hand grip that is slidingly engaged to the main body, said hand grip being configured to transition between a FIRE position where the trigger assembly of the firearm is accessible, and a SAFE position where the trigger assembly of the firearm is not accessible, a release button that is positioned along the main body, said release button functioning to allow the system to transition between the SAFE position and the FIRE position when engaged, and a dual locking assembly that is positioned within the main body, and configured to control an operation of the release button to transition from the SAFE position to the FIRE position, wherein the dual locking assembly includes an electromechanical locking unit and a separate mechanical locking unit that are each independently coupled to the release button and are each configured to independently allow an operation of the release button, and wherein the dual locking assembly does not control an operation of the release button to transition from the FIRE position to the SAFE position.

* * * * *